US010183190B2

(12) United States Patent
Holland et al.

(10) Patent No.: US 10,183,190 B2
(45) Date of Patent: Jan. 22, 2019

(54) FLEXIBLE EXERCISE STATION

(71) Applicants: Kevin Isaac Holland, Kerrville, TX (US); Leslie Ann Holland, Kerrville, TX (US); Jessica Katelynn Holland, Kerrville, TX (US); Jason Robert Holland, Kerrville, TX (US)

(72) Inventors: Kevin Isaac Holland, Kerrville, TX (US); Leslie Ann Holland, Kerrville, TX (US); Jessica Katelynn Holland, Kerrville, TX (US); Jason Robert Holland, Kerrville, TX (US)

( * ) Notice: Subject to any disclaimer, the term of this patent is extended or adjusted under 35 U.S.C. 154(b) by 0 days.

(21) Appl. No.: 15/217,991

(22) Filed: Jul. 23, 2016

(65) Prior Publication Data

US 2018/0021622 A1 Jan. 25, 2018

(51) Int. Cl.

| | |
|---|---|
| ***A63B 21/00*** | (2006.01) |
| ***A63B 21/04*** | (2006.01) |
| ***A63B 23/02*** | (2006.01) |
| ***A63B 23/035*** | (2006.01) |

(52) U.S. Cl.

CPC ..... *A63B 21/0442* (2013.01); *A63B 21/0005* (2013.01); *A63B 21/00047* (2013.01); *A63B 21/4035* (2015.10); *A63B 23/0233* (2013.01); *A63B 23/0238* (2013.01); *A63B 23/03516* (2013.01)

(58) Field of Classification Search

CPC ..... A63B 21/0442; A63B 21/005–21/0557; A63B 21/0407

See application file for complete search history.

(56) References Cited

U.S. PATENT DOCUMENTS

| | | | | |
|---|---|---|---|---|
| 8,317,667 | B1 * | 11/2012 | Thomas | A63B 21/0555 482/121 |
| 2009/0270231 | A1 * | 10/2009 | Hall | A63B 21/0552 482/79 |
| 2011/0319230 | A1 * | 12/2011 | Brendle | A63B 23/03541 482/37 |
| 2015/0251039 | A1 * | 9/2015 | Mikulski | A63B 21/0442 482/126 |
| 2017/0021219 | A1 * | 1/2017 | Kelly | A61H 7/001 |
| 2017/0028242 | A1 * | 2/2017 | Miyoshi | A61H 7/001 |

* cited by examiner

*Primary Examiner* — Jennifer M Deichl
(74) *Attorney, Agent, or Firm* — Frank H. Pham; Pham IP Group

(57) ABSTRACT

A portable and removable mounted exercise station includes an elongated anchoring member disposed on a surface of an external stationary object, such as a wall. The anchoring module has a doorknob shaped cleat, a plurality of knobs, and brackets formed in both ends of the elongated anchoring member. A corner mounting adapter to mount the station in a corner where two walls meet. A resistance band connects to one of the knobs to provide resistance during an exercise routine. A clip allows for quick connect and disconnect of the resistance band to the station.

3 Claims, 6 Drawing Sheets

FLEXIBLE EXERCISE STATION

BACKGROUND OF THE INVENTION

1. Field of the Invention

The field of the invention relates to exercise equipment and, in particular, relates to a portable and removable mounted exercise station that enables users to use resistance bands at various positions on the station. Further, a strap boot may be connected to the station as well to attach resistance bands directly to the foot for leg exercises and stretches.

2. Description of the Prior Art

Exercise stations may fasten resistance bands to doors through use of nylon straps and clamps. Existing prior art describes use of an anchoring strap to secure the exercise apparatus to either a door frame or to another immovable object. Another prior art describes attachment of a device to a door with a clamp that is fastened to the top of the door. The prior art discloses a resistance band adjustable strap that loops vertically around a door. On one side of the strap are a series of loops running from the floor to the top of the door. Resistance bands are slipped through the strap loops. A prior art describes use of a door mounted strap and tension-locking clamp to secure a band vertically around a door. These devices are based on nylon straps.

Another type of device uses a rail system to adjust position. For example, the prior art describes a rail system that employs a vertically sliding "wall mount channel" that can be locked in place.

A need exists in the art for a flexible exercise station that is portable and removable to overcome the above problems.

SUMMARY OF THE INVENTION

The present invention provides a portable and removable mounted exercise station that can be disposed on a surface of an external stationary object such as wall and requires no adjustment for user of any age, height, or physical limitations.

In a preferred embodiment according to the present invention, the portable and removable exercise station includes an elongated anchoring member that may be mounted or secured onto an external stationary object such as wall by mounting brackets. The mounting brackets are constructed in a flat steel L-shaped plate attached to the top and bottom ends of the elongated anchoring member.

The elongated anchoring member may take various shapes and forms. In this example, elongated anchoring member is an elongated hollow tube having a plurality holes on the sides. The elongated anchoring member may be made of, for example, metal such as stainless steel or other rigid materials of sufficient rigidity to withstand stress applied by a user. The exercise station is removably mounted on the surface such as wall by securing the attached mounting brackets to a structural framing within a wall by a single lag bolt and washer.

The front of the elongated anchoring member has pre-drilled holes located equally from the top end to the center of the member for optional accessories. All anchoring modules in doorknob shaped cleat are pre-mounted to reduce the risk of error by potential user incorrectly or inadequately attaching them making the device safe enough to be used with any resistance band on the market and for ease of installation for the potential user.

A knot buster is used for holding a loop end of the resistance band to keep the loop of the resistance band from slipping off as it is pulled in any direction.

The portable and removable exercise station employs a use of resistance bands and static looped straps or similar devices. Resistance band is connectable to one of the anchoring modules attached on the elongated anchoring member.

Multiple resistance bands may be connected to multiple anchoring modules at desired positions. For example resistance band of a first resistance may be connected at a high position on the elongated anchoring member for arm exercises, and resistance band of a second resistance may be connected at a low position on the elongated anchoring member for leg exercises. Thus, a user may perform multiple exercises at the same time. The system of clip and removable anchoring modules allows a user to quickly and easily change the position of resistance bands.

Permanent screw hole for a screw may be placed through permanent mounting opening to mount the portable and removable exercise station on a more permanent basis.

Knot-buster used to massage or break up knots in muscles located at the base of the neck and in the shoulder areas is attached to the front of the elongated anchoring member and is adjustable to compensate for varying heights.

Strap boost attaching resistance bands directly to the foot for leg exercises and stretches wraps around a shoe with multiple D-rings giving the user unlimited freedom to create own personalized workout.

Loop-end adapter is a nylon loop with a D-ring sliding over an anchoring module to allow the use of multiple resistance band attached to the resistance band that has a clip instead of a looped end. The D-ring allows for the attachment of any clip or hooked end to attach allowing the user to use any resistance band on the market in conjunction with this device.

Further objects and advantages of the present invention will become apparent from a description of the several embodiments as set forth in the following description and drawings.

DETAILED DESCRIPTION OF THE INVENTION

Figure 1:
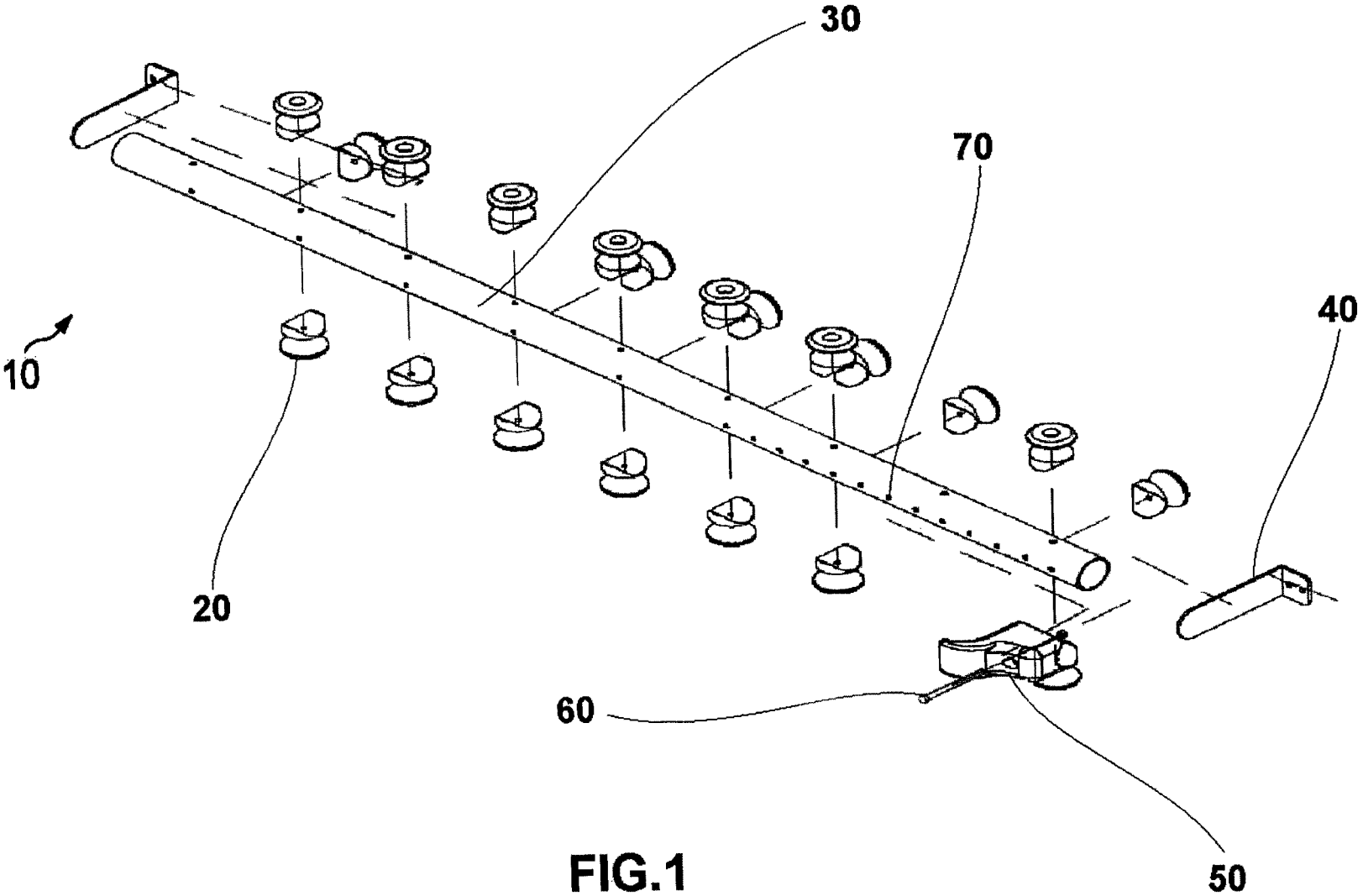
FIG. 1 is an example method for assembling the flexible exercise station having multiple knobs attachments.
Figure 2B:
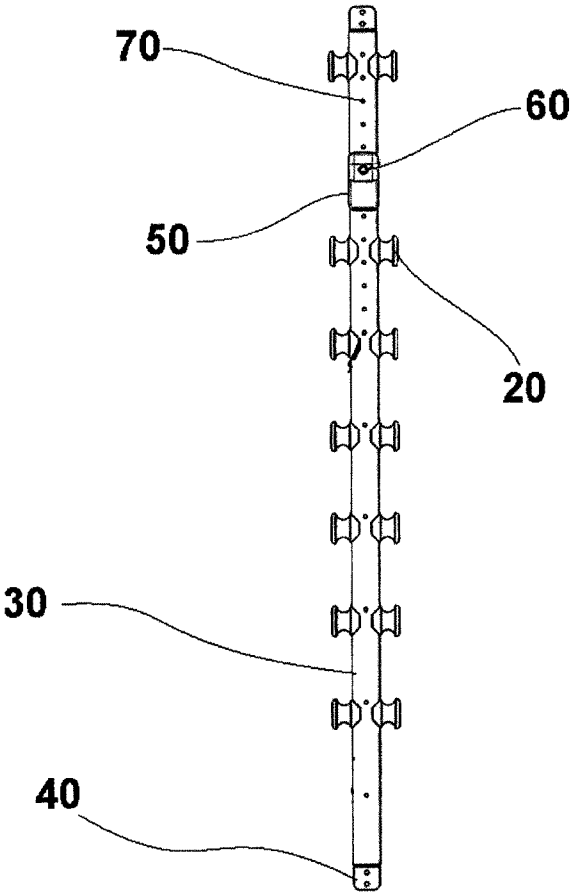
FIG. 2B illustrates a front view of the portable and removable mounted exercise station according to the present invention.
Figure 2A:
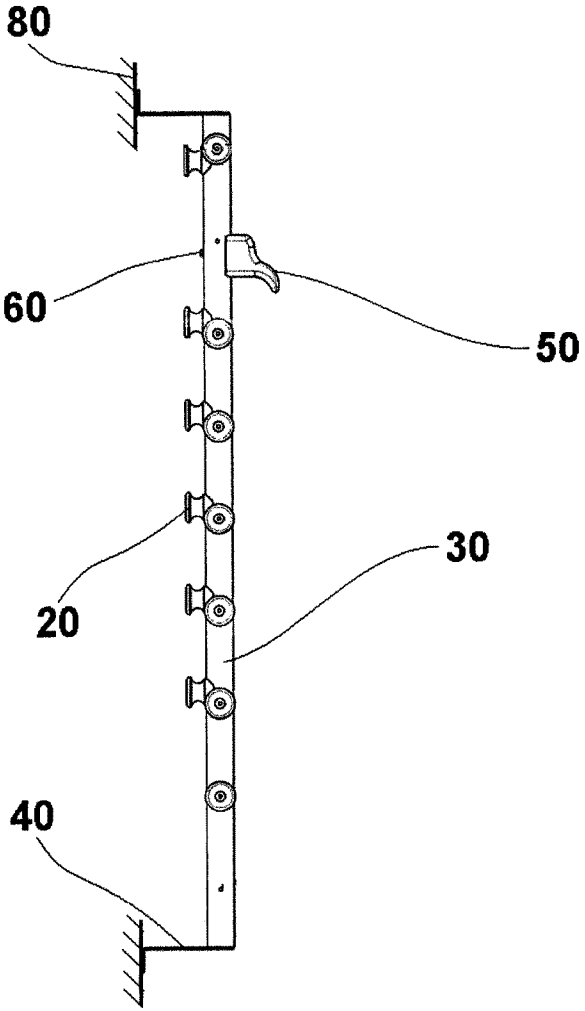
FIG. 2A illustrates a side view of the portable and removable mounted exercise station according to the present invention.

FIG. 1 shows a portable and removable mounted exercise station 10 according to a first embodiment of the present invention. The exercise station 10 includes elongated anchoring member 30, knot buster 50, L-shaped bracket 40, and anchoring module 20. As shown in FIGS. 2A and 2B, the exercise station 10 may be mounted or secured onto a wall 100 (as an example of an external stationary object).

The elongated anchoring member 30 may take various shapes and forms. In this example, elongated anchoring member 30 is an elongated tube and may be made of, for example, metal such as stainless steel or other rigid materials of sufficient rigidity to withstand stress applied by a user.

FIGS. 1-2AB shows the elongated anchoring member 30 including permanent drilled hole 80. A screw 60 may be placed through permanent screw hole to attach the knot buster 50 on the elongated anchoring member 30. Additional screw may be placed through permanent screw hole on the bracket 40 to mount removable mounted exercise station 10 on a more permanent basis.

Figure 3B:
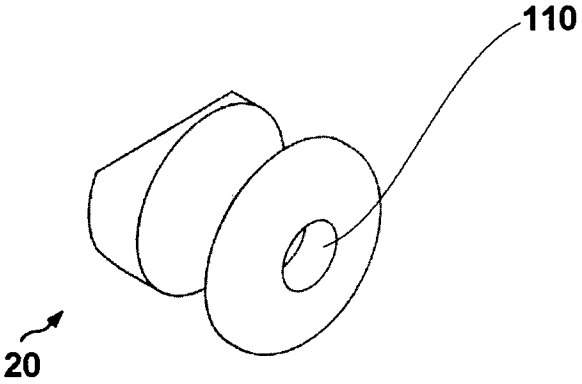
FIG. 3B illustrates a perspective view of the anchoring module.
Figure 6:
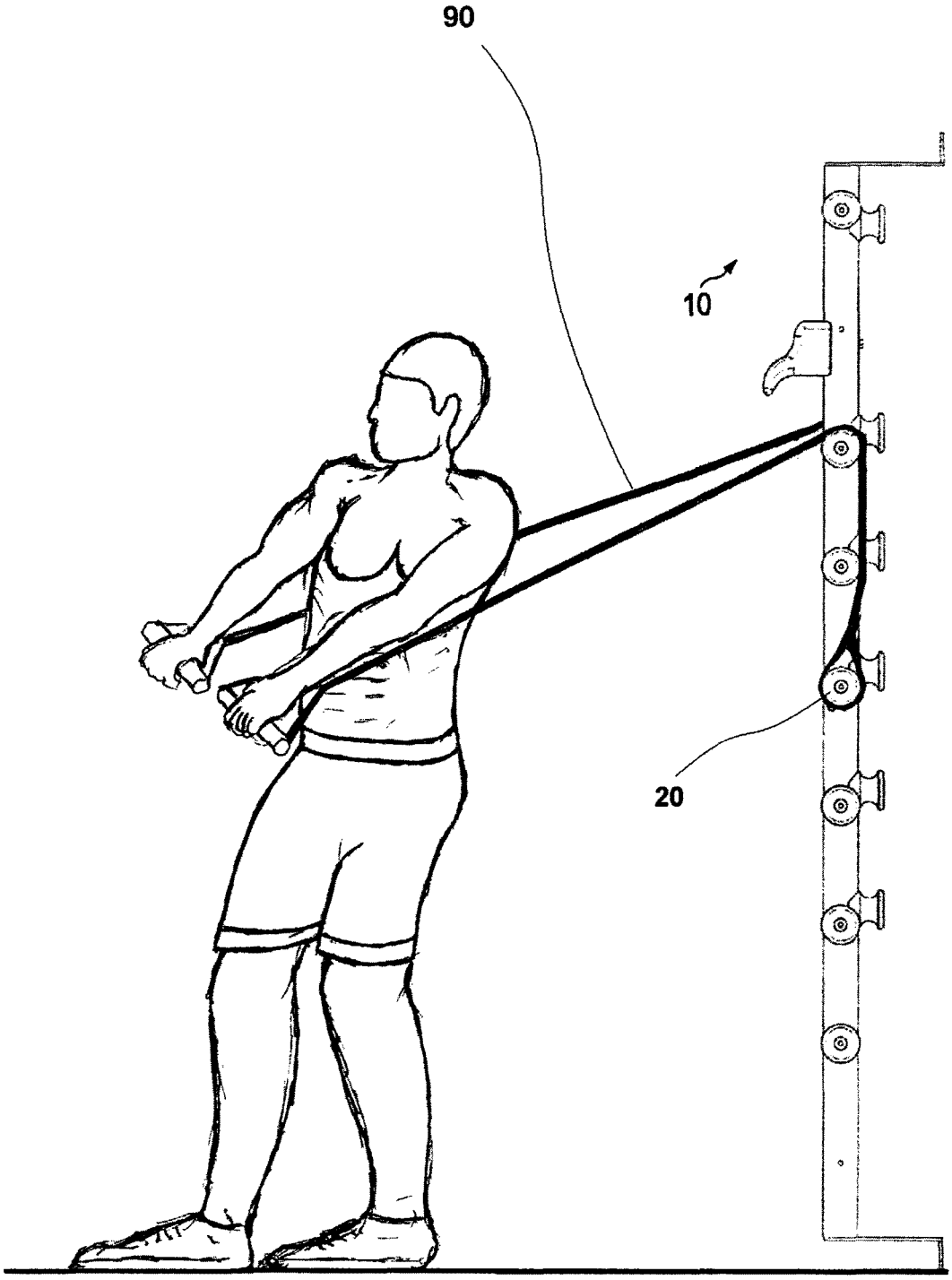

Elongated anchoring member 10 may also include a plurality of pre-drilled holes for attaching the anchoring modules 20. The anchoring module keeps the loop of the resistance band 90 as shown in FIG. 6 from slipping off when the resistance band 90 is pulled in many directions during the many variations of exercises, stretches or physical therapy movements. The doorknob shape of the anchoring module 20 as shown in FIG. 3B adds resistance to any workout by wrapping the resistance band 90 from the original anchoring module around another anchoring module. A screw may be placed through permanent screw hole 110 on the anchoring module 20 to secure the anchoring module 20 on the elongated anchoring member 30. This configuration allows the user to change the position of the resistance band 90 when exercising to increase the resistance, thereby saving space to workout.

Figure 3A:
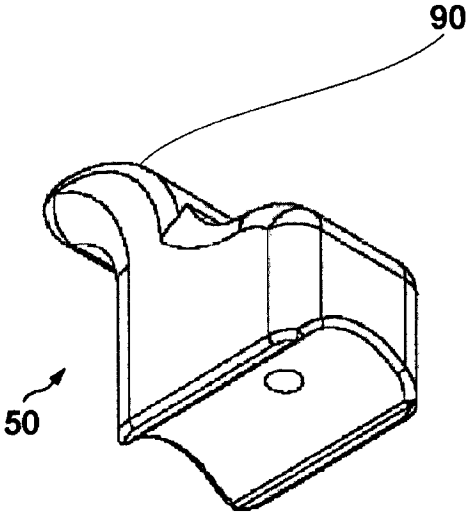
FIG. 3A illustrates a perspective view of the knot buster.

FIG. 3A shows a perspective view of the knot buster 50 which is an optional accessory used to massage and break up knots in muscles located at the base of the neck and in the shoulder areas. The knot buster 50 uses a carriage bolt 60 to secure it to the exercise station 10 and is adjustable to compensate for varying heights of the users. User can place the shoulder muscle groups under the knot buster 50, press upward using legs to apply pressure against the downward facing point, and use body to move around and massage the area.

Figure 4:
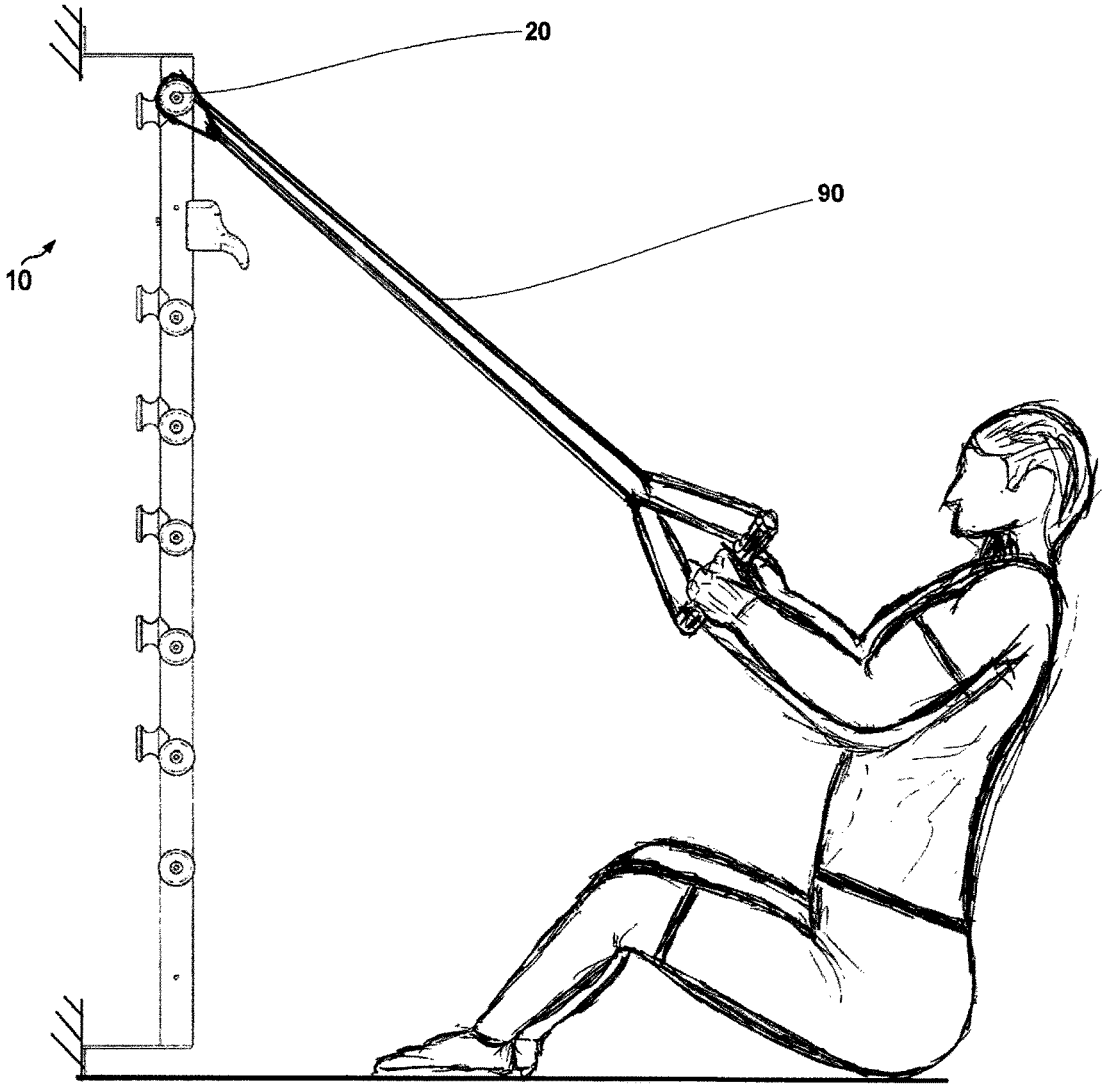
FIGS. 4, 5, and 6 illustrate different workout positions by a user.
Figure 5:
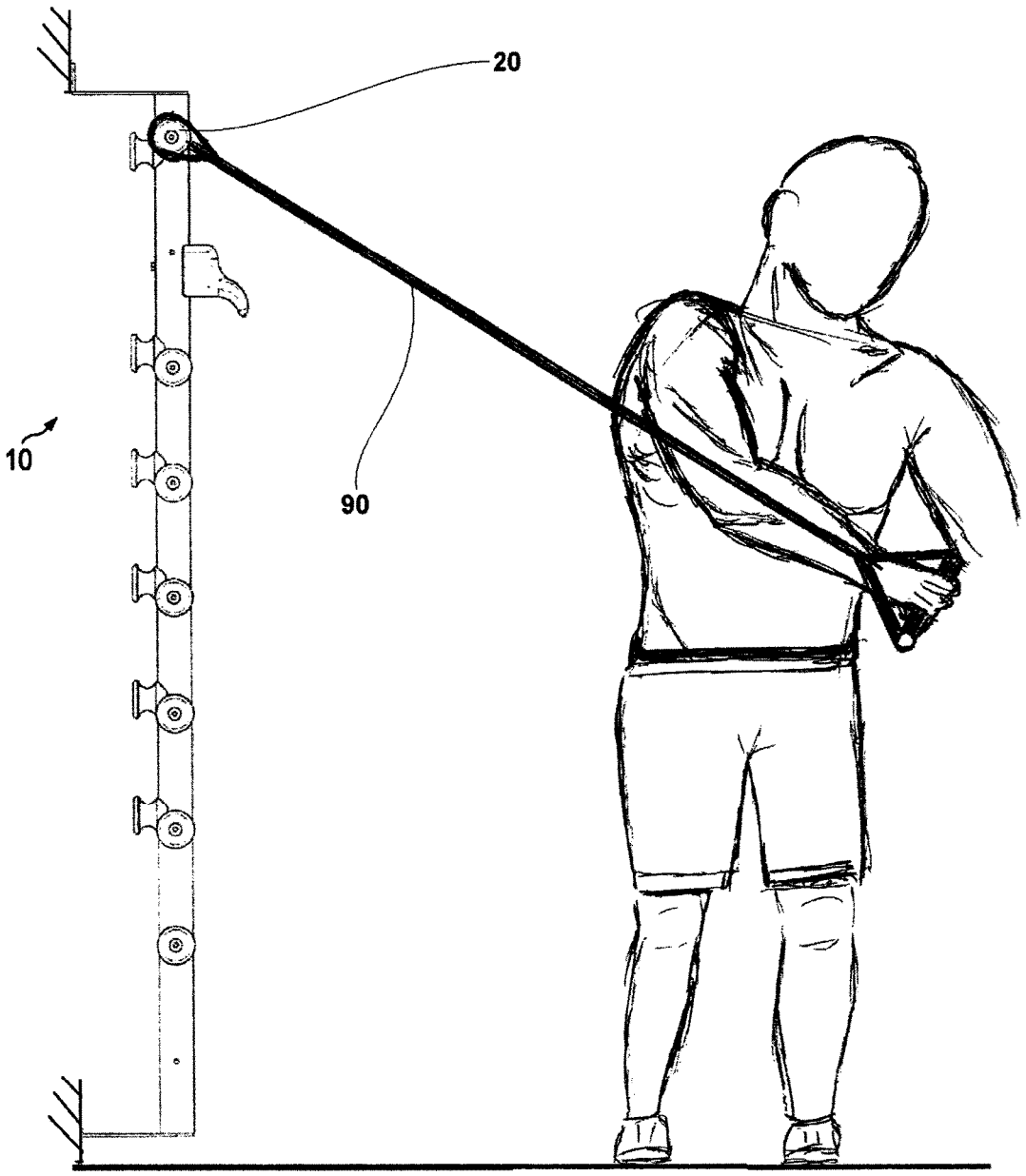

FIGS. 4, 5, and 6 depicts the portable and removable mounted exercise station 10 according to the embodiment of the present invention mounted or secured on a wall 100 for different exercise positions. In this embodiment, resistance band 90 is wrapped around anchoring module 20. That is, resistance band 90 extends vertically from the elongated anchoring member 30 and wraps around anchoring module 20. The end loop of the resistance band 90 may be adjustable into different positions as previously described to tighten the resistance around anchoring module 20.

The resistance band 90 may be secured to multiple anchoring modules 20 at desired positions. For example, resistance band 90 of a first resistance may be secured at a high position on the elongated anchoring member 30 shown by FIGS. 4-5 for arm and upper chest exercises, and resistance band 90 of a second resistance may be secured at a low position on the elongated anchoring member 30 for shoulder exercise as illustrated in FIG. 6. Thus, a user may perform multiple exercises at the same time. The system of multiple anchoring modules allows a user to quickly and easily change the position of the resistance bands 90.

The embodiments were chosen and described to best explain the principles of the invention and its practical application to persons who are skilled in the art. As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above described exemplary embodiments, but should be defined only in accordance with the following claims appended hereto and their equivalents.

Having illustrated and described the principles of the present invention in a preferred embodiment, it will be apparent to those skilled in the art that the embodiment can be modified in arrangement and detail without departing from such principles. Any and all such embodiments are intended to be included within the scope of the following claims.

What is claimed is:

1. A portable and removable mounted exercise station comprising:

(a) an elongated hollow metal tube anchoring member having a plurality of pre-drilled holes with pre-determined spacing vertically from a front side through a back side and from a left side through a right side to form holes on the front side, the back side, the left side, and the right side, wherein the elongated hollow metal tube anchoring member is configured to be mounted or secured on a surface of an external stationary object;

(b) a plurality of removable doorknob shaped anchoring modules removably secured on the elongated hollow metal tube anchoring member vertically spaced on the front side, the back side, the left side, and the right side;

(c) a plurality of resistance bands configured to be secured to the anchoring modules at different positions to increase or decrease resistance provided to a user;

(d) at least one L-shaped mounting bracket attached on each of a first end and a second end of the elongated hollow metal tube anchoring member for mounting to an external stationary object;

(e) at least one adjustable knot buster secured on the elongated hollow metal tube for massaging a neck and shoulder area of a user, wherein a height of the knot buster is adjustable; and (f) a plurality of screws configured to be received by the holes for securing the doorknob shaped anchoring modules on the front side, the back side, the left side, and the right side of the elongated hollow metal tube anchoring member.

2. The portable and removable mounted exercise station of claim 1, wherein the knot buster is removably attached to the elongated hollow metal tube anchoring member via a bolt.

3. The portable and removable mounted exercise station of claim 1, wherein the plurality of resistance bands are configured to wrap around the doorknob shaped anchoring modules for increasing resistance and decreasing space required for exercise.

* * * * *